US010652683B2

(12) United States Patent
Chon et al.

(10) Patent No.: US 10,652,683 B2
(45) **Date of Patent: *May 12, 2020**

(54) METHOD AND APPARATUS FOR REPRODUCING THREE-DIMENSIONAL AUDIO

(71) Applicant: SAMSUNG ELECTRONICS CO., LTD., Suwon-si (KR)

(72) Inventors: Sang-bae Chon, Suwon-si (KR); Sun-min Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/166,589

(22) Filed: Oct. 22, 2018

(65) Prior Publication Data

US 2019/0058959 A1 Feb. 21, 2019

Related U.S. Application Data

(63) Continuation of application No. 15/110,861, filed as application No. PCT/KR2015/000303 on Jan. 12, 2015, now Pat. No. 10,136,236.

(30) Foreign Application Priority Data

Jan. 10, 2014 (KR) ..... 10-2014-0003619

(51) Int. Cl.
*H04S 3/00* (2006.01)
*G10L 19/008* (2013.01)
(Continued)

(52) U.S. Cl.
CPC ..... *H04S 3/008* (2013.01); *G10L 19/008* (2013.01); *G10L 19/20* (2013.01); *H04S 5/005* (2013.01);
(Continued)

(58) Field of Classification Search
None
See application file for complete search history.

(56) References Cited

U.S. PATENT DOCUMENTS 8,639,368 B2 1/2014 Oh et al.
9,082,395 B2 7/2015 Heiko et al.
(Continued)

FOREIGN PATENT DOCUMENTS

CN 1864436 A 11/2006
CN 102099854 A 6/2011
(Continued)

OTHER PUBLICATIONS

Communication dated Dec. 20, 2016, issued by the European Patent Office in counterpart European application No. 15734960.6.
(Continued)

*Primary Examiner* — Curtis A Kuntz
*Assistant Examiner* — Kenny H Truong
(74) *Attorney, Agent, or Firm* — Sughrue Mion, PLLC

(57) ABSTRACT

A three-dimensional (3D) audio reproducing method and apparatus is provided. The 3D audio reproducing method may include receiving a multichannel signal comprising a plurality of input channels; and performing downmixing according to a frequency range of the multichannel signal in order to format-convert the plurality of input channels into a plurality of output channels having elevation.

2 Claims, 9 Drawing Sheets

(51) Int. Cl.

| | |
|---|---|
| ***H04S 5/00*** | (2006.01) |
| ***G10L 19/20*** | (2013.01) |
| ***H04S 7/00*** | (2006.01) |

(52) U.S. Cl.

CPC ..... *H04S 7/307* (2013.01); *H04S 2400/01* (2013.01); *H04S 2400/03* (2013.01); *H04S 2400/07* (2013.01); *H04S 2420/01* (2013.01); *H04S 2420/07* (2013.01)

(56) References Cited

U.S. PATENT DOCUMENTS

| | | | |
|---|---|---|---|
| 9,269,361 | B2 | 2/2016 | Ragot et al. |
| 9,445,187 | B2 | 9/2016 | Oh et al. |
| 9,462,404 | B2 | 10/2016 | Herre et al. |
| 10,299,056 | B2 | 5/2019 | Walsh et al. |
| 2002/0071574 | A1 | 6/2002 | Aylward |
| 2010/0017003 | A1 | 1/2010 | Oh |
| 2011/0255588 | A1 | 10/2011 | Shim et al. |
| 2012/0008789 | A1 | 1/2012 | Kim et al. |
| 2012/0314875 | A1 | 12/2012 | Lee et al. |
| 2013/0016843 | A1 | 1/2013 | Herre et al. |
| 2013/0262130 | A1 | 10/2013 | Ragot |
| 2015/0199973 | A1 | 7/2015 | Borsum |
| 2015/0269948 | A1 | 9/2015 | Purnhagen et al. |
| 2016/0133262 | A1 | 5/2016 | Fueg |
| 2017/0032812 | A1 | 2/2017 | Kasada |

FOREIGN PATENT DOCUMENTS

| | | | |
|---|---|---|---|
| CN | 102388417 | A | 3/2012 |
| CN | 101899307 | B | 1/2013 |
| CN | 103081512 | A | 5/2013 |
| CN | 103329197 | A | 9/2013 |
| CN | 103366748 | A | 10/2013 |
| KR | 10-2008-0066121 | A | 7/2008 |
| KR | 10-2011-0052562 | A | 5/2011 |
| KR | 10-2012-0004909 | A | 1/2012 |
| KR | 10-2012-0004916 | A | 1/2012 |
| KR | 10-2012-0006010 | A | 1/2012 |
| KR | 10-2012-0137253 | A | 12/2012 |
| KR | 10-2014-0004086 | A | 1/2014 |
| WO | 2009/046223 | A2 | 4/2009 |

OTHER PUBLICATIONS

Communication dated Jun. 29, 2018, issued by the State Intellectual Property Office of P.R. China in counterpart Chinese Application No. 201580012023.7.

Communication dated Apr. 25, 2017, issued by the State Intellectual Property Office of the People's Republic of China in counterpart Chinese Patent Application No. 201580012023.7.

Holzer, et al., "Working Draft Text of MPEG-H 3D Audio CO RM0", International Organization for Standardization, Nov. 2013, 1 page total, Geneva, Switzerland.

Kangeun Lee, et al., "Virtual Reproduction of Spherical Multichannel Sound Over 5.1 Speaker System", 2012 IEEE International Conference on Consumer Electronics (ICCE), Jan. 13, 2012, pp. 11-12.

Neuendorf, M., "ISO/IEC 23003-3:201x/FDIS of Unified Speech and Audio Coding", International Organisation for Standardisation, Jul. 2011, 293 pages total, Torino Italy.

Search Report dated Mar. 23, 2015, issued by the International Searching Authority in counterpart International Patent Application No. PCT/KR2015/000303 (PCT/ISA/210).

Sungyoung Kim, et al., "Virtual Ceiling Speaker: Elevating auditory imagery in a 5-channel reproduction", Audio Engineering Society Convention Paper 7886, Presented at the 127th Convention Oct. 9-12, 2009, New York NY, USA, total 12 pages.

Wenhai Wu, et al., "Parametric Stereo Coding Scheme With a New Downmix Method and Whole Band Inter Channel Time/Phase Differences", ICASSP 2013, 2013 IEEE, May 26-31, 2013, pp. 556-560.

Written Opinion dated Mar. 23, 2015, issued by the International Searching Authority in counterpart International Patent Application No. PCT/KR2015/000303 (PCT/ISA/237).

Young Woo Lee, et al., "Virtual Height Speaker Rendering for Samsung 10.2-channel Vertical Surround System", Audio Engineering Society Convention Paper 8523, Presented at the 131st Convention, Oct. 20-23, 2011, New York, NY, USA, total 10 pages.

Communication dated Nov. 18, 2019, issued by the Indian Patent Office in counterpart Indian Application No. 201627025473.

Communication dated Nov. 28, 2019, issued by the Korean Patent Office in counterpart Korean Application No. 10-2014-0003619.

METHOD AND APPARATUS FOR REPRODUCING THREE-DIMENSIONAL AUDIO

CROSS REFERENCE TO RELATED APPLICATIONS

This is a Continuation of U.S. application Ser. No. 15/110,861 filed Jul. 11, 2016, which is a National Stage of International Application No. PCT/KR2015/000303, filed on Jan. 12, 2015, which claims priority from Korean Patent Application No. 10-2014-0003619 filed Jan. 10, 2014, the entire content of which is incorporated herein by reference.

TECHNICAL FIELD

The present invention relates to a three-dimensional (3D) audio reproducing method and apparatus for providing an overhead sound image by using given output channels.

BACKGROUND ART

Due to advances in video and audio processing technologies, multimedia content having high image quality and high audio quality is widely available. Users desire content having high image quality and high sound quality with realistic video and audio, and accordingly research into three-dimensional (3D) video and 3D audio is being actively conducted.

3D audio is a technology in which a plurality of speakers are located at different positions on a horizontal plane and output the same audio signal or different audio signals, thereby enabling a user to perceive a sense of space. However, actual audio is provided at various positions on a horizontal plane and is also provided at different heights. Therefore, development of a technology for effectively reproducing an audio signal provided at different heights via a speaker located on a horizontal plane is required.

DETAILED DESCRIPTION OF THE INVENTION

Technical Problem

The present invention provides a three-dimensional (3D) audio reproducing method and apparatus for providing an overhead sound image in a reproduction layout including horizontal output channels.

Technical Solution

According to an aspect of the present invention, there is provided a three-dimensional (3D) audio reproducing method including receiving a multichannel signal comprising a plurality of input channels; and performing downmixing according to a frequency range of the multichannel signal in order to format-convert the plurality of input channels into a plurality of output channels having a sense of elevation.

The performing downmixing may include performing downmixing on a first frequency range of the multichannel signal after a phase alignment on the first frequency range and performing downmixing on a remaining second frequency range of the multichannel signal without a phase alignment.

The first frequency range may have a lower frequency band than a predetermined frequency.

The plurality of output channels may include horizontal channels.

The performing downmixing may include applying different downmixing matrices, based on characteristics of the multichannel signal.

The characteristics of the multichannel signal may include a bandwidth and a correlation degree.

The performing downmixing may include applying one of timbral rendering and spatial rendering, according to a rendering type included in a bitstream.

The rendering type may be determined according to whether characteristic of the multichannel signal is transient.

According to another aspect of the present invention, there is provided a 3D audio reproducing apparatus including a core decoder configured to decode a bitstream; and a format converter configured to receive a multichannel signal comprising a plurality of input channels from the core decoder and configured to perform downmixing according to a frequency range of the multichannel signal in order to render the plurality of input channels into a plurality of output channels having a sense of elevation.

Advantageous Effects

In a reproduction layout including horizontal output channels, when elevation rendering or spatial rendering is performed on a vertical input channel, execution or non-execution of a phase alignment with respect to input signals is determined, and then downmixing is performed. Thus, a signal in a specific frequency range among rendered output channel signals does not undergo a phase alignment, and thus accurate synchronization may be provided.

Moreover, a signal in a remaining frequency range undergoes both a phase alignment and downmixing, and thus an increase in a calculation amount and degradation in elevation perception during the overall active downmixing process may be minimized.

MODE OF THE INVENTION

Figure 1:
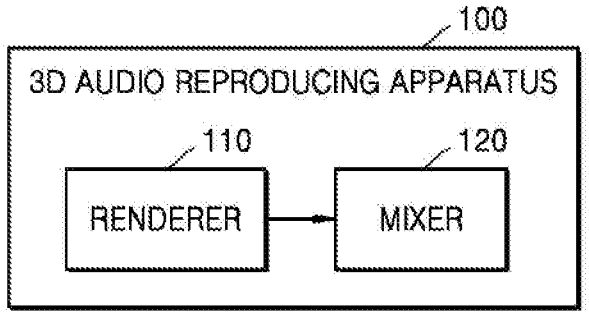
FIG. 1 is a block diagram of a schematic structure of a three-dimensional (3D) audio reproducing apparatus according to an embodiment.

Embodiments will now be described more fully hereinafter with reference to the accompanying drawings. In the drawings, like elements are denoted by like reference numerals, and a repeated explanation thereof will not be given.

Embodiments may, however, be embodied in many different forms and should not be construed as being limited to exemplary embodiments set forth herein. However, this does not limit the present disclosure and it should be understood that the present disclosure covers all modifications, equivalents, and replacements within the idea and technical scope of the inventive concept. In the description of the embodiments, certain detailed explanations of the related art are omitted when it is deemed that they may unnecessarily obscure the essence of the inventive concept. However, one of ordinary skill in the art may understand that the present invention may be implemented without such specific details.

While the terms including an ordinal number, such as "first", "second", etc., may be used to describe various components, such components must not be limited by theses terms. The terms first and second should not be used to attach any order of importance but are used to distinguish one element from another element.

The terms used in the below embodiments are merely used to describe particular embodiments, and are not intended to limit the scope of the inventive concept. An expression used in the singular encompasses the expression of the plural, unless it has a clearly different meaning in the context. In the below embodiments, it is to be understood that the terms such as "including", "having", and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

In the below embodiments, the terms " . . . module" and " . . . unit perform at least one function or operation, and may be implemented as hardware, software, or a combination of hardware and software. Also, a plurality of " . . . modules" or a plurality of " . . . units" may be integrated as at least one module and thus implemented with at least one processor, except for " . . . module" or " . . . unit" that is implemented with specific hardware.

Figure 2:
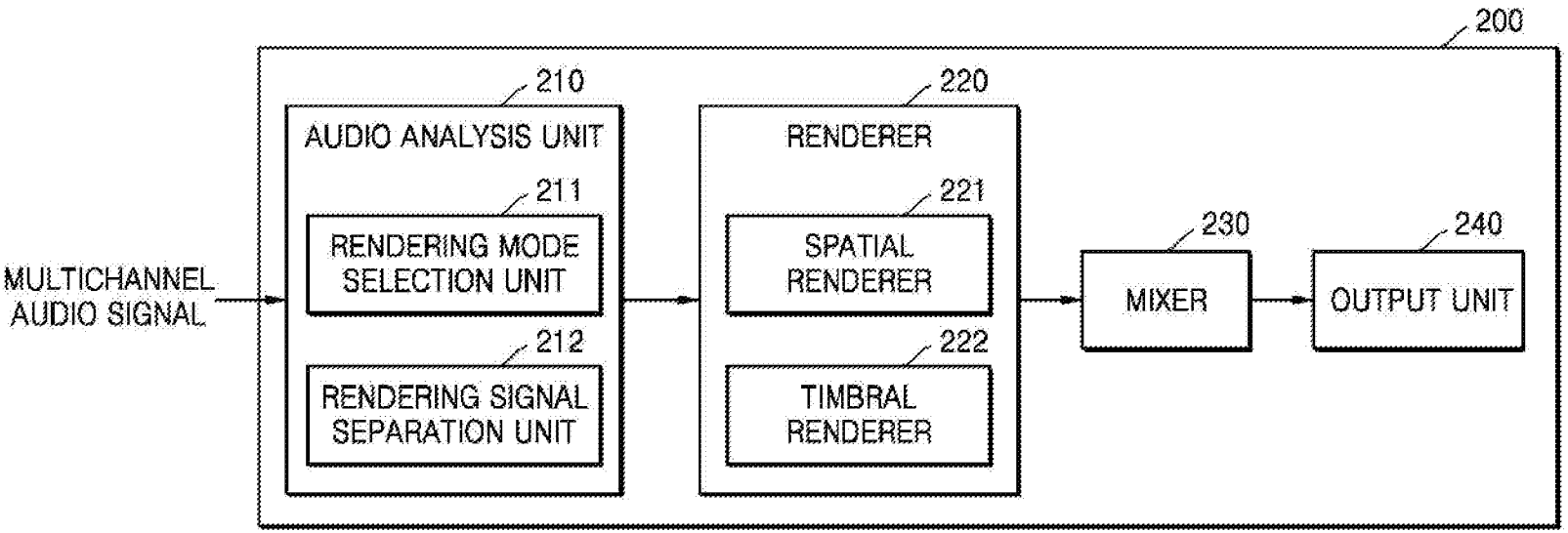
FIG. 2 is a block diagram of a detailed structure of a 3D audio reproducing apparatus according to an embodiment.

FIGS. 1 and 2 are block diagrams of three-dimensional (3D) audio reproducing apparatuses 100 and 200 according to an embodiment. The 3D audio reproducing apparatus 100 may output a downmixed multichannel audio signal to channels to be reproduced. The channels to be reproduced are referred to as output channels, and the multichannel audio signal is assumed to include a plurality of input channels. According to an embodiment, the output channels may correspond to horizontal channels, and the input channels may correspond to horizontal channels or vertical channels.

3D audio refers to an audio that enables a listener to have an immersive sense by reproducing a sense of direction or distance as well as a pitch and a tone and has space information that enables a listener, who is not located in a space where a sound source is generated, to sense a direction, a distance and a space.

In the following description, a channel of an audio signal may be a speaker through which a sound is outputted. As the number of channels increases, the number of speakers may increase. The 3D audio reproducing apparatus 100 according to an embodiment may render a multichannel audio signal having a large number of channels to channels to be reproduced and downmix rendered signals, such that the multichannel audio signal is reproduced in an environment in which the number of channels is small. The multichannel audio signal may include a channel capable of outputting an elevated sound, for example, a vertical channel.

The channel capable of outputting the elevated sound may be a channel capable of outputting a sound signal through a speaker located over the head of a listener so as to enable the listener to sense elevation. A horizontal channel may denote a channel capable of outputting a sound signal through a speaker located on a plane that is at a same level as a listener.

The environment in which the number of channels is small may be an environment that no channels capable of outputting an elevated sound are included and a sound can be output through speakers arranged on a horizontal plane, namely, through horizontal channels.

In addition, in the following description, the horizontal channel may be a channel including an audio signal that can be output through a speaker arranged on a horizontal plane. An overhead channel or a vertical channel may denote a channel including an audio signal that can be output through a speaker that is arranged at an elevation but not on a horizontal plane and is capable of outputting an elevated sound.

Referring to FIG. 1, the 3D audio reproducing apparatus 100 according to an embodiment may include a renderer 110 and a mixer 120. However, all of the illustrated components are not essential. The 3D audio reproducing apparatus 100 may be implemented by more or less components than those illustrated in FIG. 1.

The 3D audio reproducing apparatus 100 may render and mix the multichannel audio signal and output a resultant multichannel audio signal to a channel to be reproduced. For example, the multichannel audio signal is a 22.2 channel signal, and the channel to be reproduced may be a 5.1 or 7.1 channel. The 3D audio reproducing apparatus 100 may perform rendering by determining channels to be matched with the respective channels of the multichannel audio signal and may combine signals of the respective channels corresponding to the determined to-be-reproduced channels to output a final signal, thereby mixing rendered audio signals.

The renderer 110 may render the multichannel audio signal according to a channel and a frequency. The renderer 110 may perform spatial rendering or elevation rendering on an overhead channel of the multichannel audio signal and may perform timbral rendering on a horizontal channel of the multichannel audio signal.

In order to render the overhead channel, the renderer 110 may render the overhead channel having passed through a spatial elevation filter (e.g., a head related transfer filter (HRTF))-based equalizer) by using different methods according to frequency ranges. The HRTF-based equalizer may transform audio signals included in the overhead channel into the tones of sounds arriving from different directions, by applying a tone transformation occurring in a phenomenon that the characteristics on a complicated path (e.g., diffraction from a head surface and reflection from auricles) as well as a simple path difference (e.g., a level difference between both ears and an arrival time difference of a sound signal between both ears) are changed according to a sound arrival direction. The HRTF-based equalizer may process the audio signals included in the overhead channel by changing the sound quality of the multichannel audio signal, so as to enable a listener to recognize a 3D audio.

The renderer 110 may render a signal in a first frequency range from the overhead channel signal by using an add-to-the-closest-channel method, and may render a remaining signal in a second frequency range by using a multichannel panning method. For convenience of explanation, the signal in the first frequency range is referred to as a low-frequency signal, and the signal in the second frequency range are referred to as a high-frequency signal. Preferably, the signal in the second frequency range may denote a signal of 2.8 to 10 KHz, and the signal in the first frequency range may denote a remaining signal, namely, a signal of 2.8 KHz or less or a signal of 10 KHz or greater. According to the multichannel panning method, gain values which are differently set for different channels to be rendered may be applied to the multichannel audio signal, and thus each channel signal of the multichannel audio signal may be rendered to at least one horizontal channel. The channel signals, to which the gain values have been respectively applied, may be combined via mixing and output as a final signal.

Since the low-frequency signal has a strong diffractive characteristic, similar sound quality may be provided to a listener even when each channel signal of the multichannel audio signal is rendered to only one channel, instead that each channel signal is rendered to a plurality of channels according to the multichannel panning method. Therefore, the 3D audio reproducing apparatus 100 according to an embodiment may render the low-frequency signal by using the add-to-the-closest-channel method, thus preventing sound quality from being degraded when a plurality of channels are mixed to one output channel. That is, if a plurality of channels are mixed to one output channel, sound quality may be amplified or decreased according to interference between the channel signals, resulting in degradation in sound quality. Therefore, the degradation in sound quality may be prevented by mixing one channel to one output channel.

According to the add-to-the-closest-channel method, each channel of the multichannel audio signal may be rendered to the closest channel among channels to be reproduced, instead of being rendered to a plurality of channels.

In addition, by performing rendering on a multichannel audio signal having different frequencies by using different methods, the 3D audio reproducing apparatus 100 may widen a sweet spot without degrading sound quality. That is, by rendering a low-frequency signal having a strong diffractive characteristic by using the add-to-the-closest-channel method, degradation of sound quality when a plurality of channels are mixed to one output channel may be prevented. The sweet spot may be a predetermined range that enables a listener to optimally listen to a 3D audio without distortion. As a sweet spot is wider, a listener may optimally listen to a 3D audio without distortion in a wide range. When a listener is not located in a sweet spot, the listener may listen to a sound with distorted sound quality or sound image.

The mixer 120 may output a final signal by combining signals of the input channels panned to the horizontal output channels by the renderer 110. The mixer 120 may mix the signals of the input channels in units of predetermined sections. For example, the mixer 120 may mix the signals of the input channels in units of frames.

The mixer 120 according to an embodiment may downmix signals rendered according to frequency, by using an active downmixing method. In detail, the mixer 120 may mix a low-frequency signal by using an active downmixing method. The mixer 120 may mix a high-frequency signal by using a power preserving method of determining an amplitude of the final signal or a gain to be applied to the final signal based on a power value of signals rendered to the channels to be reproduced. The mixer 120 may also downmix the high-frequency signal by using a method except for a method of mixing signals without phase alignment, not by only using the power preserving method.

In the active downmixing method, before downmixing is performed using a covariance matrix between signals that are combined to a channel to which the signals are to be mixed, the phases of the signals are first aligned. For example, the phases of the signals may be aligned based on a signal having largest energy from among the signals to be downmixed. According to the active downmixing method, the phases of the signals that are to be downmixed are aligned so that constructive interference may occur between the signals that are to be downmixed, and thus distortion of sound quality due to destructive interference that may occur during downmixing may be prevented. In particular, when correlated sound signals that are out of phase are input and downmixed according to the active downmixing method, occurrence of a phenomenon that a tone of the downmixed sound signals changes or a sound disappears due to destructive interference may be prevented.

In virtual rendering, an overhead channel signal passes through an HRTF-based equalizer and a 3D audio signal is reproduced via multichannel panning. According to this virtual rendering, synchronous sound sources are reproduced via a surround speaker, and thus 3D audio with elevation perception may be output. In particular, due to the reproduction of the synchronous sound sources via a surround speaker, identical binaural signals may be provided, and thus an overhead sound image may be provided.

However, when signals are downmixed according to the active downmixing method, the phases of the signals may become different, and thus the signals of the channels are desynchronized with each other and accordingly elevation perception may not be provided. For example, when overhead channel signals are desynchronized with each other during downmixing, an elevation perception that is recognizable due to an arrival time difference of a sound signal between both ears disappears, and thus sound quality may degrade due to the application of the active downmixing method.

Thus, the mixer 120 may mix the low-frequency signal having a strong diffractive characteristic according to the active downmixing method, since an arrival time difference of a sound signal between both ears is rarely recognized and phase overlapping noticeably occurs in a low-frequency component. The mixer 120 may mix a high-frequency signal with a strong elevation perception recognizable due to the arrival time difference of a sound signal between both ears, according to a mixing method including no phase alignment. For example, the mixer 120 may mix the high-frequency signal while minimizing distortion of sound quality caused by the destructive interference, by preserving the energy cancelled due to the destructive interference according to the power preserving method.

In addition, according to an embodiment, by considering a band component having a specific crossover frequency or higher as a high frequency and considering a remaining band component as a low frequency in a quadrature mirror filter (QMF) bank, rendering and mixing may be performed on each of the low-frequency signal and the high-frequency signal. A QMF may be a filter that divides an input signal into a low frequency signal and a high frequency signal and outputs the low frequency and the high frequency.

Active downmixing may be performed on each frequency band, and includes a very large amount of calculation, such as calculation of a covariance between channels to be downmixed. Accordingly, when only a low-frequency signal is mixed via active downmixing, the amount of calculation may be reduced. For example, if the 3D audio reproducing apparatus 100 performs downmixing on only signals of 2.8 kHz or less and 10 kHz or greater from among a signal sampled at 48 kHz after performing phase alignment thereon and performs downmixing on the remaining signals of 2.8 kHz to 10 kHz without phase alignment in a QMF bank, the calculation amount may be reduced by about ⅓.

In addition, as for substantially-recorded sound sources, high-frequency signals have a low probability that a channel signal is in phase with another channel. Thus, when the high-frequency signals are mixed via active downmixing, unnecessary calculations may be performed.

Referring to FIG. 2, the 3D audio reproducing apparatus 200 according to an embodiment may include an audio analysis unit 210, a renderer 220, a mixer 230, and an output unit 240. The 3D audio reproducing apparatus 200, the renderer 220, and the mixer 230 in FIG. 2 correspond to the 3D audio reproducing apparatus 100, the renderer 110, and the mixer 120 in FIG. 1, and thus, redundant descriptions thereof are omitted. However, all of the illustrated components are not essential. The 3D audio reproducing apparatus 200 may be implemented by more or less components than those illustrated in FIG. 2.

The audio analysis unit 210 may select a rendering mode by analyzing a multichannel audio signal and may separate and output some signals from the multichannel audio signal. The audio analysis unit 210 may include a rendering mode selection unit 211 and a rendering signal separation unit 212.

The rendering mode selection unit 211 may determine whether many transient signals, such as a sound of applause, a sound of rain, and the like, are present in the multichannel audio signal, in units of predetermined sections. In the following description, an audio signal including many transient signals, such as the sound of applause or the sound of rain, will be referred to as an applause signal.

The 3D audio reproducing apparatus 200 according to an embodiment may separate the applause signal from the multichannel audio signal and perform channel rendering and mixing according to the characteristic of the applause signal.

The rendering mode selection unit 211 may select one of a general mode and an applause mode as a rendering mode, according to whether the applause signal is included in the multichannel audio signal in units of frames. The renderer 220 may perform rendering according to the mode selected by the rendering mode selection unit 211. That is, the renderer 220 may render the applause signal according to the selected mode.

The rendering mode selection unit 211 may select the general mode when no applause signals are included in the multichannel audio signal. In the general mode, the overhead channel signal may be rendered by a spatial renderer 221 and the horizontal channel signal may be rendered by a timbral renderer 222. That is, rendering may be performed without taking into account the applause signal.

The rendering mode selection unit 211 may select the applause mode when the applause signal is included in the multichannel audio signal. In the applause mode, the applause signal may be separated and timbral rendering may be performed on the separated applause signal.

The rendering mode selection unit 211 may determine whether the applause signal is included in the multichannel audio signal, in units of predetermined sections or frames, by using applause bit information that is included in the multichannel audio signal or is separately received from another device. According to an MPEG-based codec, the applause bit information may include bsTsEnable or bsTempShapeEnableChannel flag information, and the rendering mode selection unit 211 may select the rendering mode according to the above-described flag information.

In addition, the rendering mode selection unit 211 may select the rendering mode based on the characteristic of a predetermined section or frame of the multichannel audio signal desired to be determined. That is, the rendering mode selection unit 211 may select the rendering mode according to whether the characteristic of the predetermined section or frame of the multichannel audio signal has the characteristic of an audio signal including the applause signal.

The rendering mode selection unit 211 may determine whether the applause signal is included in the multichannel audio signal, based on at least one condition among whether a wideband signal that is not tonal to a plurality of input channels is present in the predetermined section or frame of the multichannel audio signal and wideband signals corresponding to channels have similar levels, whether an impulse of a short section is repeated, and whether inter-channel correlation is low.

The rendering mode selection unit 211 may select the applause mode as the rendering node, when it is determined that the applause signal is included in a current section of the multichannel audio signal.

When the rendering mode selection unit 211 selects the applause mode, the rendering signal separation unit 212 may separate the applause signal included in the multichannel audio signal from a general sound signal.

When a bsTsdEnable flag based on MPEG USAC is used, timbral rendering may be performed according to the flag information, regardless of elevation of a corresponding channel, as in the horizontal channel signal. In addition, the overhead channel signal may be assumed to be the horizontal channel signal and may be downmixed according to the flag information. That is, the rendering signal separation unit 212 may separate the applause signal included in the predetermined section of the multichannel audio signal according to the flag information, and the separated applause signal may undergo timbral rendering, as in the horizontal channel signal.

In a case where no flags are used, the rendering signal separation unit 212 may analyze a signal between the channels and separate an applause signal component. The applause signal separated from the overhead signal may undergo timbral rendering, and the signals other than the applause signal may undergo spatial rendering.

The renderer 220 may include the spatial renderer 221 that renders the overhead channel signal according to a spatial rendering method, and the timbral renderer 222 that renders the horizontal channel signal or the applause signal according to the timbral rendering method.

The spatial renderer 221 may render the overhead channel signal by using different methods according to frequency. The spatial renderer 221 may render a low-frequency signal by using the add-to-the-closest-channel method and may render a high-frequency signal by using the timbral rendering method. Hereinafter, the spatial rendering method may be a method of rendering the overhead signal, and may include a multichannel panning method.

The timbral renderer 222 may render the horizontal channel signal or the applause signal by using at least one selected from the timbral rendering method, the add-to-the-closest-channel method, and an energy boost method. Hereinafter, the timbral rendering method may be a method of rendering the horizontal channel signal, and may include a downmix equation or a vector base amplitude panning (VBAP) method.

The mixer 230 may calculate the rendered signals in units of channels and output the final signal. The mixer 230 according to an embodiment may mix signals rendered according to frequency, according to the active downmixing method. Therefore, the 3D audio reproducing apparatus 200 according to an embodiment may reduce tone distortion by mixing the low-frequency signal according to the active downmixing method in which downmixing is performed after a phase alignment. The tone distortion may be caused by destructive interference. The 3D audio reproducing apparatus 200 may mix the high-frequency signal except for the low-frequency signal according to a method of performing downmixing without performing phase alignment, for example, the power preserving method, thereby preventing elevation perception from being degraded due to the application of the active downmixing method.

The output unit 240 may finally output a mixed signal output by the mixer 230, through the speaker. At this time, the output unit 240 may output a sound signal through different speakers according to the channels of the mixed signal.

Figure 3:
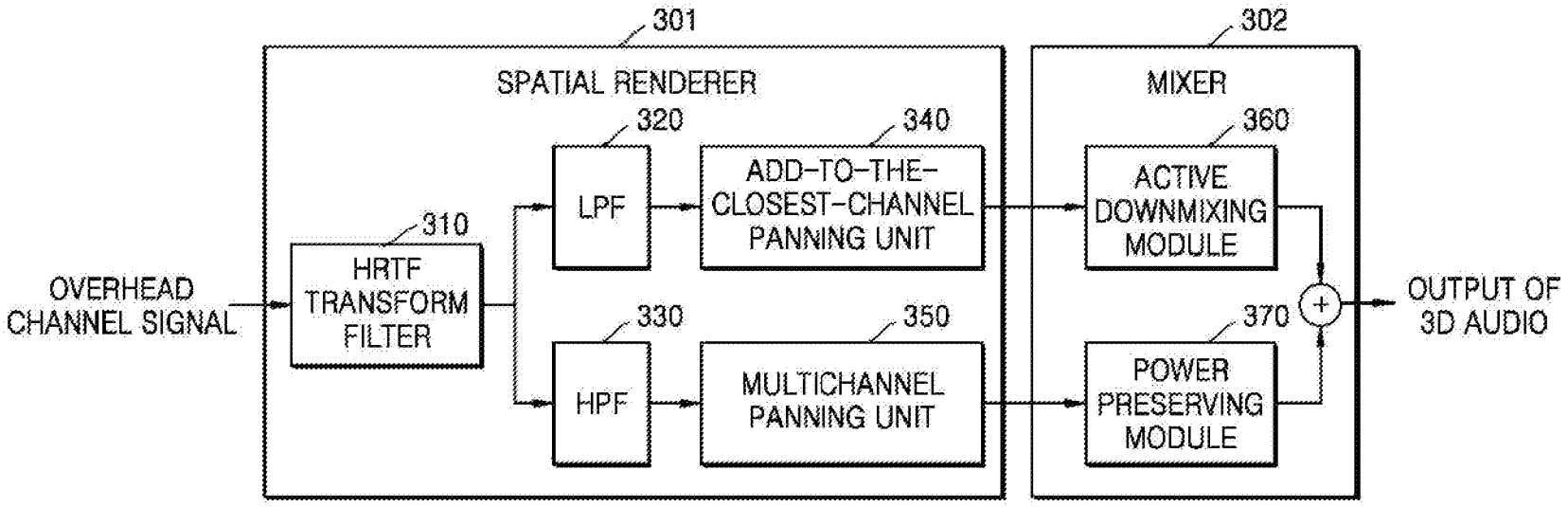
FIG. 3 is a block diagram of a renderer and a mixer according to an embodiment.

FIG. 3 is a block diagram of a spatial renderer 301 and a mixer 302 according to an embodiment. The spatial renderer 301 and the mixer 302 of FIG. 3 correspond to the spatial renderer 221 and the mixer 230 of FIG. 2, and thus, redundant descriptions thereof are omitted. However, all of the illustrated components are not essential. The spatial renderer 301 and the mixer 302 may be implemented by more or less components than those illustrated in FIG. 3.

Referring to FIG. 3, the spatial renderer 301 may include an HRTF transform filter 310, a low-pass filter (LPF) 320, a high-pass filter (HPF) 330, an add-to-the-closest-channel panning unit 340, and a multichannel panning unit 350.

The HRTF transform filter 310 may perform HRTF-based equalizing on an overhead channel signal included in a multichannel audio signal.

The LPF 320 may separate a component in a specific frequency range, for example, a low frequency component of 2.8 kHz or less, from the HRTF-based equalized overhead channel signal.

The HPF 330 may separate a high-frequency component of 2.8 kHz or greater, from the HRTF-based equalized overhead channel signal.

A band pass filter instead of the LPF 320 and the HPF 330 may classify a frequency component of 2.8 kHz to 10 kHz as a high-frequency component and classify the remaining frequency component as a low-frequency component.

The add-to-the-closest-channel panning unit 340 may render the low frequency component of the overhead channel signal to the closest channel when the overhead channel is projected on horizontal plane.

The multichannel panning unit 350 may render the high frequency component of the overhead channel signal according to the multichannel panning method.

Referring to FIG. 3, the mixer 302 may include an active downmixing module 360 and a power preserving module 370.

The active downmixing module 360 may mix the low frequency component of the overhead channel signal rendered by the add-to-the-closest-channel panning unit 340, according to the active downmixing method. The active downmixing module 360 may mix the low frequency component according to an active downmixing method of aligning the phases of signals combined for each channel in order to induce constructive interference.

The power preserving module 370 may mix the high frequency component of the overhead channel signal rendered by the multichannel panning unit 350, according to the power preserving method. The power preserving module 370 may mix the high-frequency component according to a power preserving method of determining an amplitude of a final signal or a gain to be applied to the final signal based on a power value of signals respectively rendered to the channels. According to an embodiment, the power preserving module 370 may mix a high frequency component signal according to the above-described power preserving method, but the present invention is not limited to this embodiment. The power preserving module 370 may mix the high frequency component signal according to another method without phase alignment.

The mixer 302 may combine mixed signals obtained by the active downmixing module 360 and the power preserving module 370 to output a mixed 3D sound signal.

A 3D audio reproducing method according to an embodiment will now be described in detail with referenced to FIGS. 4 and 5.

Figure 4:
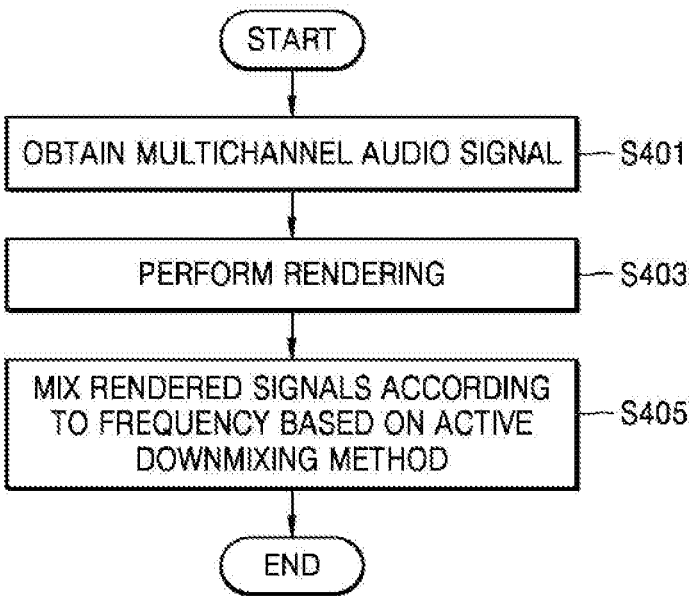
FIG. 4 is a flowchart of a 3D audio reproducing method according to an embodiment.
Figure 5:
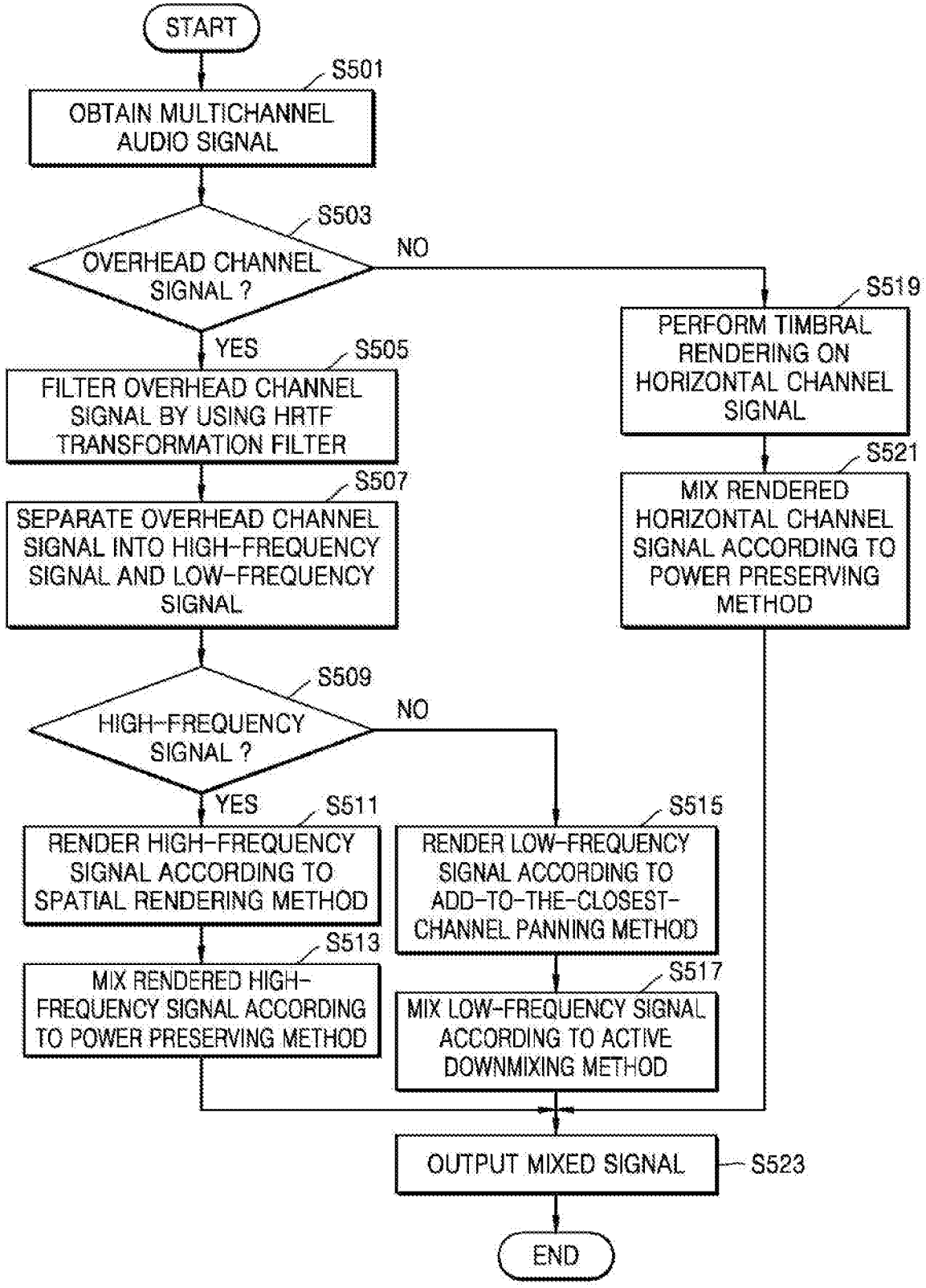
FIG. 5 is a detailed flowchart of a 3D audio reproducing method according to an embodiment.

FIGS. 4 and 5 are flowcharts of a 3D audio reproducing method according to an embodiment.

Referring to FIG. 4, in operation S401, the 3D audio reproducing apparatus 100 may obtain a multichannel audio signal desired to be reproduced.

In operation S403, the 3D audio reproducing apparatus 100 may perform rendering on each channel. According to an embodiment, the 3D audio reproducing apparatus 100 may perform rendering according to frequency, but the present invention is not limited to this embodiment. The 3D audio reproducing apparatus 100 may perform rendering according to various methods.

In operation S405, the 3D audio reproducing apparatus 100 may mix rendered signals obtained in operation S403 according to frequency based on the active downmixing method. In detail, the 3D audio reproducing apparatus 100 may perform downmixing on a first frequency range including a low-frequency component after performing phase alignment thereon, and may perform downmixing on a second frequency range including a high-frequency component without performing phase alignment. For example, the 3D audio reproducing apparatus 100 may mix the high-frequency component, according to a power preserving method of performing mixing so that energy cancelled due to a destructive interference may be preserved, by applying a gain determined according to a power value of signals respectively rendered for channels.

Accordingly, the 3D audio reproducing apparatus 100 according to an embodiment may minimize elevation perception degradation that may occur by applying the active downmixing method to a high-frequency component in a specific frequency range, for example, 2.8 kHz to 10 kHz.

FIG. 5 is a flowchart of rendering and mixing for each frequency included in the 3D audio reproducing method of FIG. 4.

Referring to FIG. 5, in operation S501, the 3D audio reproducing apparatus 100 may obtain the multichannel audio signal desired to be reproduced. When the multichannel audio signal includes an applause signal, the 3D audio reproducing apparatus 100 may separate the applause signal from the multichannel audio signal and perform channel rendering and mixing according to the characteristic of the applause signal.

In operation S503, the 3D audio reproducing apparatus 100 may separate an overhead channel signal and a horizontal channel signal from the multichannel audio signal obtained in operation S501 and may perform rendering and mixing on each of the overhead channel signal and the horizontal channel signal. In other words, the 3D audio reproducing apparatus 100 may perform spatial rendering and mixing on the overhead channel signal and perform timbral rendering and mixing on the horizontal channel signal.

In operation S505, the 3D audio reproducing apparatus 100 may filter the overhead channel signal by using an HRTF transformation filter so that an elevation perception may be provided.

In operation S507, the 3D audio reproducing apparatus 100 may separate the overhead channel signal into a signal of a high-frequency component and a signal of a low-frequency component and perform rending and mixing on the signal of the high-frequency component and the signal of the low-frequency component.

In operations S509 and S511, the 3D audio reproducing apparatus 100 may render the high-frequency signal of the overhead channel signal according to the spatial rendering method. The spatial rendering method may include a multichannel panning method. Multichannel panning may denote channel signals of the multichannel audio signal being allocated to channels to be reproduced. In this case, channel signals to which a panning coefficient has been applied may be allocated to the channels to be reproduced. The high-frequency component signal may be allocated to a surround channel in order to provide the characteristic that an interaural level difference (ILD) decreases as elevation perception increases. A sound signal may be localized by a front channel and the number of a plurality of channels to be panned.

In operation S513, the 3D audio reproducing apparatus 100 may mix a rendered high-frequency signal obtained in operation S511, according to a method other than the active downmixing method. For example, the 3D audio reproducing apparatus 100 may mix the rendered high-frequency signal by using a power preserving module.

In operation S515, the 3D audio reproducing apparatus 100 may render the low-frequency signal of the overhead channel signal according to the above-described add-to-the-closest-channel panning method. When many signals, namely, several channel signals of a multichannel audio signal, are mixed to a single channel, sound quality is cancelled or amplified due to a difference between phases of the several channel signals and the single channel, leading to degradation in sound quality. According to the add-to-the-closest-channel panning method, the 3D audio reproducing apparatus 100 may map the low-frequency signal with the closest channel when the low frequency signal is projected on each channel horizontal plane, in order to prevent the degradation in sound quality.

When the multichannel audio signal is a frequency signal or a filter bank signal, a bin or band corresponding to a low frequency may be rendered according to the add-to-the-closest-channel panning method, and a bin or band corresponding to a high frequency may be rendered according to the multichannel panning method. The bin or band may denote a signal section corresponding to a predetermined unit in a frequency domain.

In operation S521, the 3D audio reproducing apparatus 100 may mix a rendered horizontal channel signal obtained in operation S519, according to the power preserving method.

In operation S523, the 3D audio reproducing apparatus 100 may mix the overhead channel signal and the horizontal channel signal to output a mixed final signal.

Figure 6:
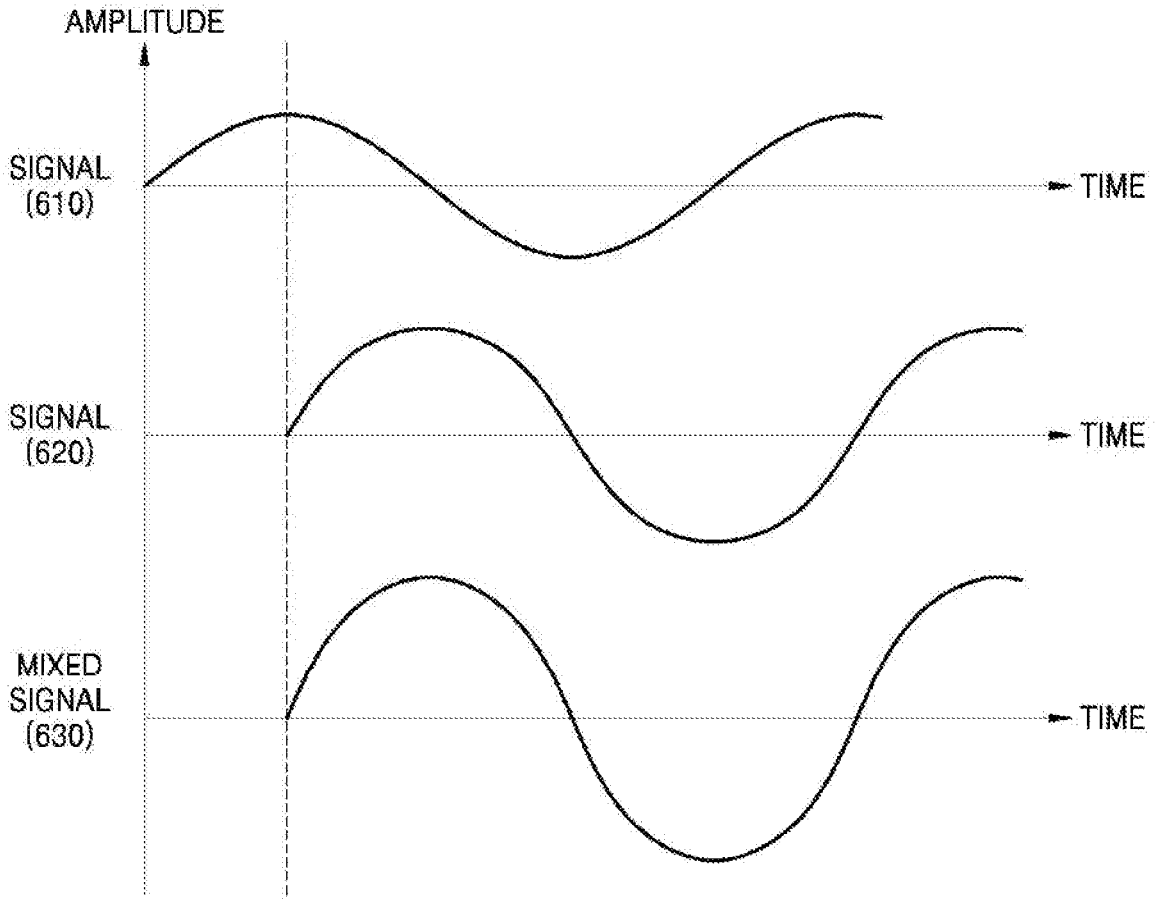
FIG. 6 explains an active downmixing method according to an embodiment.

FIG. 6 is a graph showing an example of an active downmixing method according to an embodiment.

When a signal 610 and a signal 620 are mixed, the two signals 610 and 620 are out of phase with each other, and thus a destructive interference may occur therebetween, leading to distortion in sound quality. Accordingly, according to the active downmixing method, the phase of the signal 610 having relatively small energy is aligned with the phase of the signal 620, and each of the phase-aligned signals 610 and 620 may be mixed. Referring to a mixed signal 630, a constructive interference may occur as the phase of the signal 610 is shifted behind.

Figure 7:
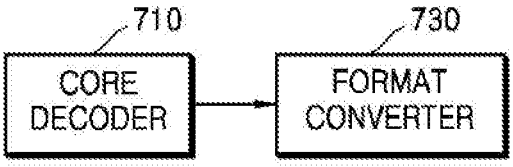
FIG. 7 is a block diagram of a structure of a 3D audio reproducing apparatus according to another embodiment.

FIG. 7 is a block diagram of a structure of a 3D audio reproducing apparatus according to another embodiment. The 3D audio reproducing apparatus of FIG. 7 may roughly include a core decoder 710 and a format converter 730.

Referring to FIG. 1, the core decoder 710 may decode a bitstream to output an audio signal having a plurality of input channels. According to an embodiment, the core decoder 710 may operate according to Unified Speech and Audio Coding (USAC) algorithm, but the present invention is not limited thereto. In this case, the core decoder 110 may output, for example, an audio signal having a 22.2 channel format. The core decoder 710 may output, for example, the audio signal having a 22.2 channel format by upmixing a downmixed single or stereo channel included in the bitstream. In terms of a reproducing environment, a channel may mean a speaker.

The format converter 730 is included to convert the format of a channel, and may be implemented using a downmixer that converts a received channel structure having a plurality of input channels into a plurality of output channels having a desired reproduction format. The number of output channels is less than that of input channels. The plurality of input channels may include a plurality of horizontal channels and at least one vertical channel having an elevation. Each vertical channel may be a channel capable of outputting a sound signal through a speaker located over the head of a listener so as to enable the listener to sense an elevation. Each horizontal channel may be a channel capable of outputting a sound signal through a speaker that is at a same level as a listener. The plurality of output channels may include only horizontal channels.

The format converter 730 may convert the input channels with a 22.2 channel format received from the core decoder 710 into output channels with a 5.0 or 5.1 channel format, in accordance with a reproduction layout. The input channels or output channels may have various formats. The format converter 730 may use different downmix matrices according to a rendering type, based on signal characteristics. In other words, the downmixer may perform an adaptive downmixing process on a signal in a sub-band domain, for example, a QMF domain. According to another embodiment, when the reproduction layout includes only horizontal channels, the format converter 730 may provide an overhead sound image having elevation by performing virtual rendering on the input channels. The overhead sound image may be provided to a surround channel speaker, but the present invention is not limited thereto.

The format converter 730 may perform different types of rendering on the plurality of input channels, according to different types of channels. Different HRTF-based equalizers may be used depending on the type of input channel, which is a vertical channel, namely, an overhead channel. Depending on the type of input channel, which is a vertical channel, namely, an overhead channel, an identical panning coefficient may be applied to all frequencies, or different panning coefficients may be applied to different frequency ranges.

In detail, a specific vertical channel, for example, a first frequency range signal, such as a low-frequency signal of 2.8 kHz or less or a high-frequency signal of 10 kHz or greater, from among the input channels may be rendered using the add-to-closest channel panning method, whereas a second frequency range signal of 2.8 to 10 kHz may be rendered using the multichannel panning method. According to the add-to-the-closest-channel panning method, the input channels may be panned to the closest single output channel among the plurality of output channels, instead of being rendered to several channels. According to the multichannel panning method, each input channel may be panned to at least one horizontal channel by using different gains that are set for different output channels to be rendered.

When the plurality of input channels include N vertical channels and M horizontal channels, the format converter 730 may render each of the N vertical channels to a plurality of output channels and render each of the M horizontal channels to the plurality of output channels, and may mix rendering results to generate a plurality of final output channels corresponding to the reproduction layout.

Figure 8:
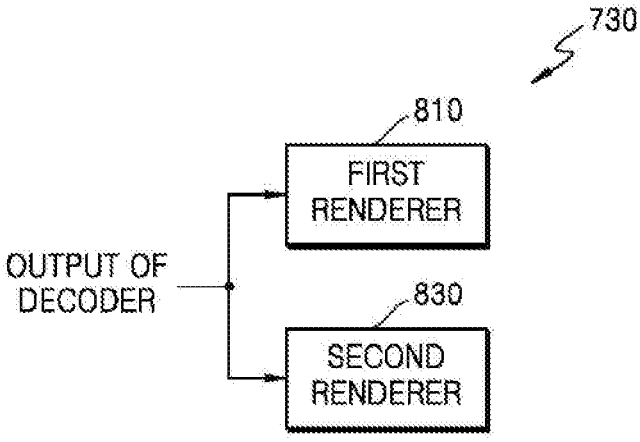
FIG. 8 is a block diagram of an audio rendering apparatus according to an embodiment.

FIG. 8 is a block diagram of an audio rendering apparatus according to an embodiment. Referring to FIG. 8, the audio rendering apparatus may include a first renderer 810 and a second renderer 830. The first renderer 810 and the second renderer 830 may operate based on a rendering type. The rendering type may be determined by an encoder end, based on an audio scene, and may be transmitted in the form of a flag. According to an embodiment, the rendering type may be determined based on a bandwidth and correlation degree of an audio signal. For example, a rendering type may be separated in a case where the audio scene in a frame has a wideband and highly decorrelated characteristic and other cases.

Referring to FIG. 8, in the case where the audio scene has a broad band and is greatly decorrelated in a frame, the first renderer 810 may perform timbral rendering by using a first downmixing matrix. The timbral rendering may be applied to a transient signal, such as an applause or the sound of rain.

In the other case where timbral rendering is not applied, the second renderer 830 may perform elevation rendering or spatial rendering by using a second downmixing matrix, thereby providing a sound image with elevation perception to a plurality of output channels.

The first and second renderers 810 and 830 may generate a downmixing parameter for an input channel format and an output channel format given in an initialization stage, namely, a downmixing matrix. To this end, an algorithm for selecting the most appropriate mapping rule for each input channel from a predesigned converter rule list may be used. Each rule is related with mapping of one input channel with at least one output channel. An input channel may be mapped with a single output channel, with two output channels, with a plurality of output channels, or with a plurality of output channels having different panning coefficients according to frequency.

Optimal mapping of each input channel may be selected according to output channels that constitute a desired reproduction layout. As a result of the mapping, a downmixing gain as well as an equalizer that is applied to each input channel may be defined.

Figure 9:
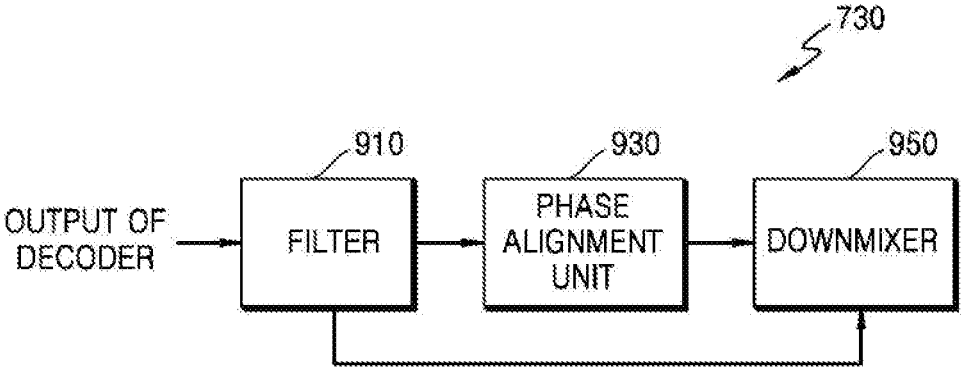
FIG. 9 is a block diagram of an audio rendering apparatus according to another embodiment.

FIG. 9 is a block diagram of an audio rendering apparatus according to another embodiment. Referring to FIG. 9, the audio rendering apparatus may roughly include a filter 910, a phase alignment unit 930, and a downmixer 950. The audio rendering apparatus of FIG. 9 may independently operate, or may be included in the format converter 730 of FIG. 7 or the second renderer 830 of FIG. 8.

Referring to FIG. 9, the filter 910 may serve as a band pass filter to filter a signal of a specific frequency range out of a vertical input channel signal among decoder outputs. According to an embodiment, the filter 910 may distinguish a frequency component of 2.8 kHz to 10 kHz from a remaining frequency component. The frequency component of 2.8 kHz to 10 kHz may be provided to the downmixer 950 without being changed, and the remaining frequency component may be provided to the phase alignment unit 930. In the case of horizontal input channels, since frequency components in all frequency ranges undergo phase alignment, the filter 910 may not be necessary.

The phase alignment unit 930 may perform a phase alignment on a frequency component in a frequency range other than 2.8 kHz to 10 kHz. A phase-aligned frequency component, namely, a frequency component of 2.8 kHz or less and 10 kHz or greater, may be provided to the downmixer 950.

The downmixer 950 may perform downmixing with respect to the frequency component received from the filter 910 or the phase alignment unit 930.

Figure 10:
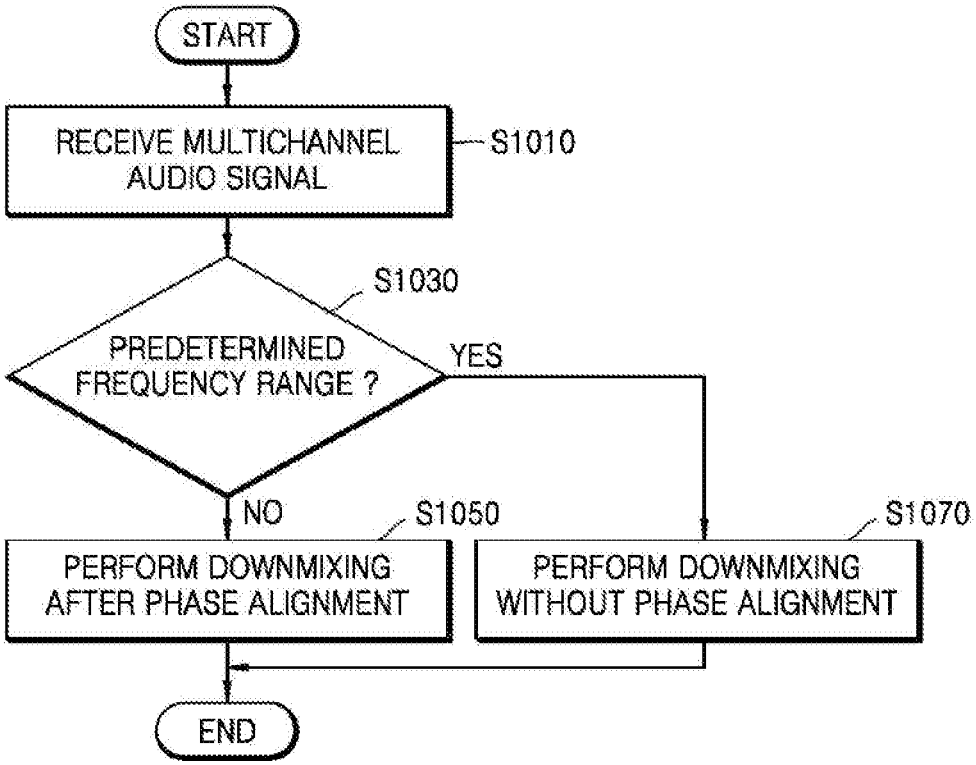
FIG. 10 is a flowchart of an audio rendering method according to an embodiment.

FIG. 10 is a flowchart of an audio rendering method according to an embodiment, and may correspond to the audio rendering apparatus of FIG. 9.

Referring to FIG. 10, in operation S1010, the audio rendering apparatus may receive a multichannel audio signal. In detail, in operation S1010, the audio rendering apparatus may receive an overhead channel signal, namely, a vertical channel signal, included in the multichannel audio signal.

In operation S1030, the audio rendering apparatus may determine a downmixing method according to a predetermined frequency range.

In operation S1050, the audio rendering apparatus may perform downmixing on a component of a frequency range other than the preset frequency range among the components of the overhead channel signal, after performing phase alignment on the component.

In operation S1070, the audio rendering apparatus may perform downmixing on a component of the preset frequency range among the components of the overhead channel signal, without performing phase alignment.

Figure 11:
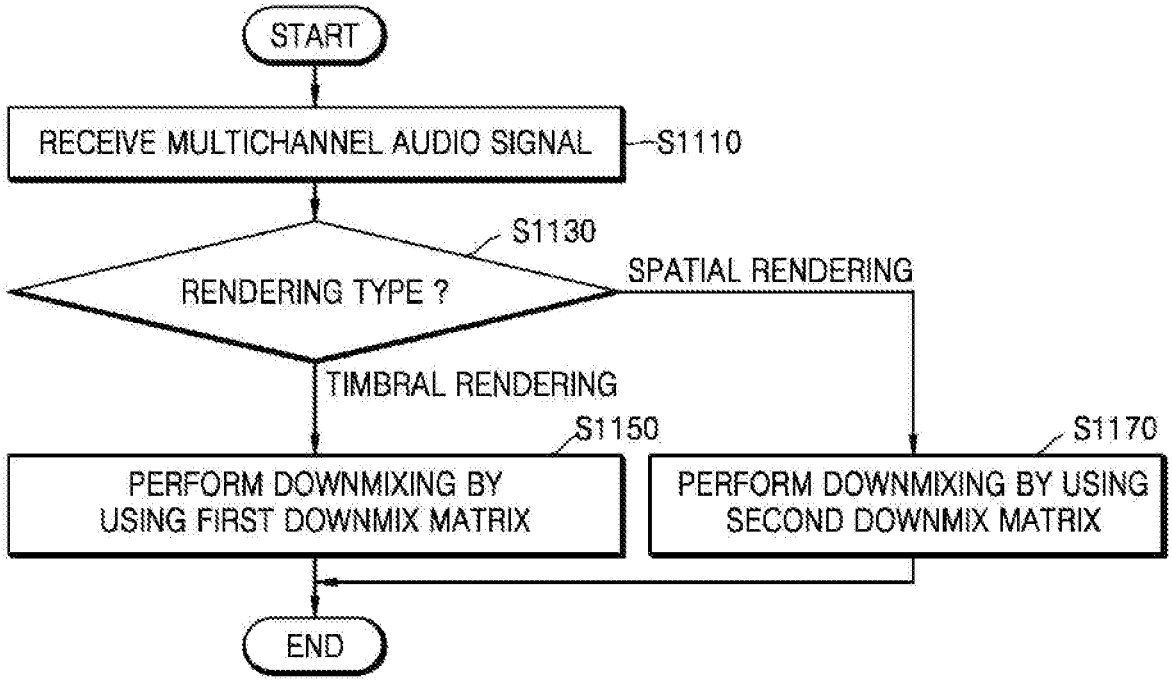
FIG. 11 is a flowchart of an audio rendering method according to another embodiment.

FIG. 11 is a flowchart of an audio rendering method according to another embodiment, and may correspond to the audio rendering apparatus of FIG. 8.

Referring to FIG. 11, in operation S1110, the audio rendering apparatus may receive a multichannel audio signal.

In operation S1130, the audio rendering apparatus may check a rendering type.

In operation S1150, when the rendering type is timbral rendering, the audio rendering apparatus may perform downmixing by using the first downmix matrix.

In operation S1170, when the rendering type is spatial rendering, the audio rendering apparatus may perform downmixing by using the second downmix matrix. The second downmix matrix for spatial rendering may include a spatial elevation filter coefficient and a multichannel panning coefficient.

The above-described embodiments are combinations of components and features of the present invention into predetermined forms. Each component or feature may be considered selective, unless specifically described. Each component or feature may be implemented without being combined with another component or feature. Some components and/or features may be combined with each other to construct an embodiment. The order of operations described in embodiments may be changed. Some components or features in one embodiment may be included in another embodiment, or may be replaced by corresponding components or features in another embodiment. Accordingly, it is obvious that claims having no explicit referring relationships with each other may be combined to construct an embodiment or may be included as new claims via an amendment after filing an application.

The embodiments may be implemented via various means, for example, hardware, firmware, software, or a combination thereof. When the embodiments are implemented via hardware, the embodiments may be implemented by at least one application specific integrated circuit (ASIC), at least one digital signal processor (DSP), at least one digital signal processing device (DSPD), at least one programmable logic device (PLD), at least one field programmable gate array (FPGA), at least one processor, at least one controller, at least one micro-controller, or at least one micro-processor.

When the embodiments are implemented via firmware or software, the embodiments can be written as computer programs by using a module, procedure, a function, or the like for performing the above-described functions or operations, and can be implemented in general-use digital computers that execute the programs using a computer readable recording medium. Data structures, program commands, or data files that may be used in the above-described embodiments may be recorded in a computer readable recording medium via several means. The computer readable recording medium is any type of storage device that stores data which can thereafter be read by a computer system, and may be located within or outside a processor. Examples of the computer-readable recording medium may include magnetic media, magneto-optical media, and a hardware device specially configured to store and execute program commands such as a read-only memory (ROM), a random-access memory (RAM), or a flash memory. The computer-readable recording medium may also be a transmission medium that transmits signals that designate program commands, data structures, or the like. Examples of the program commands may include advanced language codes that can be executed by a computer by using an interpreter or the like as well as machine language codes made by a compiler. Furthermore, the embodiments described herein could employ any number of conventional techniques for electronics configuration, signal processing and/or control, data processing and the like. The words "mechanism", "element", "means", and "configuration" are used broadly and are not limited to mechanical or physical embodiments, but can include software routines in conjunction with processors, etc.

The particular implementations shown and described herein are illustrative examples and are not intended to otherwise limit the scope of the present invention in any way. For the sake of brevity, conventional electronics, control systems, software development and other functional aspects of the systems may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical apparatus.

The use of the terms "a" and "an" and "the" and similar referents in the context of describing the present invention (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Also, the steps of all methods described herein can be performed in any suitable order unless otherwise indicated herein or otherwise clearly contradicted by context. The present invention is not limited to the described order of the steps. The use of any and all examples, or exemplary language (e.g., "such as") provided herein, is intended merely to better illuminate the inventive concept and does not pose a limitation on the scope of the inventive concept unless otherwise claimed. Numerous modifications and adaptations will be readily apparent to one of ordinary skill in the art without departing from the spirit and scope.

What is claimed is:

1. A method of rendering an audio signal, the method comprising:

receiving a plurality of input channel signals including a height input channel signal;

generating a parameter for phase-aligning based on the plurality of input channel signals;

modifying a downmix matrix, based on the parameter for phase-aligning, to phase-align a first frequency range of the plurality of input channel signals; and downmixing the plurality of input channel signals to a plurality of output channel signals based on the modified downmix matrix, wherein the first frequency range includes below 2.8 kHz and above 10 kHz, wherein the height input channel signal is identified based on elevation information, and wherein the modified downmix matrix includes two types comprising a first downmix matrix for a general scene and a second downmix matrix for a highly decorrelated wideband scene, and the downmixing is performed by one of the first downmix matrix or the second downmix matrix selected according to a received flag.

2. An apparatus for rendering an audio signal, the apparatus comprising:

a processor; and a memory storing instructions executable by the processor, wherein the processor is configured to:

receive a plurality of input channel signals including a height input channel signal;

generate a parameter for phase-aligning based on the plurality of input channel signals;

modify a downmix matrix, based on the parameter for phase-aligning, to phase-align a first frequency range of the plurality of input channel signals; and downmix the plurality of input channel signals to a plurality of output channel signals based on the modified downmix matrix, wherein the first frequency range includes below 2.8 kHz and above 10 kHz, wherein the height input channel signal is identified based on elevation information, and wherein the modified downmix matrix includes two types comprising a first downmix matrix for a general scene and a second downmix matrix for a highly decorrelated wideband scene, and the downmixing is performed by one of the first downmix matrix or the second downmix matrix selected according to a received flag.

* * * * *